United States Patent [19]

Shibata

[11] 4,412,971

[45] Nov. 1, 1983

[54] ELECTRICAL CONTACT MATERIALS OF INTERNALLY OXIDIZED AG-SN-BI ALLOY

[75] Inventor: Akira Shibata, Yokohama, Japan

[73] Assignee: Chugai Denki Kogyo K.K., Japan

[21] Appl. No.: 348,142

[22] Filed: Feb. 11, 1982

[51] Int. Cl.[3] ..... C22C 5/06

[52] U.S. Cl. ..... 420/501

[58] Field of Search ..... 420/501; 200/265, 266

[56] References Cited

FOREIGN PATENT DOCUMENTS

| | | | |
|---|---|---|---|
| 52-4092 | 1/1977 | Japan | 420/501 |
| 52-13688 | 2/1977 | Japan | 420/501 |
| 54-110124 | 8/1979 | Japan | 420/501 |
| 54-128427 | 10/1979 | Japan | 420/501 |
| 55-134144 | 10/1980 | Japan | 420/501 |
| 1434510 | 5/1976 | United Kingdom | 420/501 |

*Primary Examiner*—Brian E. Hearn
*Assistant Examiner*—David A. Hey
*Attorney, Agent, or Firm*—Shlesinger, Fitzsimmons & Shlesinger

[57] ABSTRACT

Internally oxidized Ag-Sn of 3 - less than 5 weight % alloy electrical contact materials are improved of their internal oxidation velocity and consequently of their contact resistance by the addition of 0.01–0.1 weight % of Bi. The alloy may comprise 0.01–0.5 weight % of one or more elements of the iron family.

2 Claims, No Drawings

ELECTRICAL CONTACT MATERIALS OF INTERNALLY OXIDIZED AG-SN-BI ALLOY

BRIEF SUMMARY OF THE INVENTION

This invention relates to electrical contact materials or electrical contacts thereof, which consist of a silver alloy comprising Sn and Bi and which are internally oxidized.

Such electrical contact materials which consist of an Ag alloy comprising Sn and Bi and which are made by internal oxidation, are described in U.S. Pat. No. 3,933,486. It has been known that a silver alloy containing a comparatively large amount of Sn, viz., more than 5 weight % of Sn could not be internally oxidized well, and could not produce an acceptable internally oxidized electrical contact material, on account of its poor crystalline structure. It has become possible in accordance with the aforementioned invention, to produce a high refractory, internally oxidized contact material made from a silver alloy containing more than 5 weight % of Sn, by the addition of Bi to said alloy. The addition of a small amount of Bi to such silver alloy is accompanied with 20 phenomena that it can retard the growth of silver crystalline grains, resulting in making the silver crystalline grains small, and cannot precipitate metal oxides within the silver crystalline grains but can produce the precipitation of metal oxides around the silver grain boundaries. Such phenomena are due to the fact that Bi can make a solid solution with Sn at a high temperature but its solid solubility with Sn and with Ag at a normal temperature is extremely small, and that oxygen diffusion velocities are fast around silver grain boundaries than within the grains.

Though such an internally oxidized Ag-Sn-Bi alloy is commercially and industrially acceptable as an electrical contact, it is not entirely satisfactory with respect to points that tin oxides precipitated around silver grain boundaries make it brittle as a whole, on account of their high hardness, and that as they have high refractoriness (decomposing at about 2,000° C.), its contact resistance cannot always be stable, resulting in sometimes its abnormal consumption, when it is used with switches having a low contact pressure. In U.S. Pat. No. 4,242,135, there is provided, therefore, an internally oxidized Ag-Sn-Bi alloy electrical contact material having a much stable contact resistance and a lesser consumption rate, by means of adding to said alloy an auxiliary metal element, viz., Cu which can improve mechanical characteristics of the material, such as tensile strength, elongation and so on.

While the addition of Cu improves tensile strength and elongation rate of contact materials of the aforementioned kind, it is now found that in case of an alloy of Ag-Sn 3—less than 5 weight % -Bi 0.01-1.0 weight %, their contact resistance can be substantially stable without the addition of Cu. It is also now found that while a silver alloy containing less than 5 weight % of tin could be internally oxidized without the addition of Bi, the addition of Bi thereto can accelerate the internal oxidation thereof, time required for which oxidation becomes about a half of the time required for the internal oxidation of the same alloy without Bi, resulting in producing fine alloy structures and in lowering contact resistance thereof.

The minimum amount of Sn in this invention is 3 weight %, since a silver alloy containing less than 3 weight % of Sn can be internally oxidized with stable structures, even without any addition of Bi. As to Bi, though its solid solubility with Ag at a high temperature is about 5.1 weight %, its maximum amount shall be 1.0 weight % so as to provide the alloy with an acceptable rate of elongation. Its minimum amount is 0.01 weight % so that it can achieve the abovementioned function for precipitating the oxidized solute metals around silver grain boundaries.

Hence, this invention is to provide an electrical contact 10 material made from a silver alloy comprising 3—less than 5 weight % of Sn, and 0.01-1.0 weight % of Bi, said silver alloy having been internally oxidized.

In order to avoid cracks of the alloy structure which are sometimes producible when it is subjected to internal oxidation, the addition of less than 0.5 weight % of one or more elements of the iron family would be made. The maximum amount of said elements is 0.5 weight % since their solid solubility with Ag at a high temperature is said amount. Addition of less than 0.01 weight % of said elements of the iron family to the alloy cannot affect well the recrystallization velocity of the latter.

DETAILED DESCRIPTION OF THE INVENTION

This invention is further explained with the following example.

EXAMPLE

Following alloys were prepared, in which % is by weight.

(1) Ag-Sn 3%
(2) Ag-Sn 3%-Bi 0.1%
(3) Ag-Sn 3%-Bi 0.1%-Fe 0.01%

The alloys were forged and rolled to plates of 0.4 mm in thickness, and internally oxidized under an $O_2$ atmosphere at 650° C. The time required for internal oxidation was 48 hours in case of the above alloy (1), viz., one of conventional alloys, and was 30 hours each in case of the alloys (2) and (3) of this invention.

The internally oxidized plates were punched to obtain discal contacts of 4 mm in diameter. Discal contacts thus obtained were backed with silver of 0.1 mm thickness.

Their contact resistances (voltage drops at: voltage—AC 200 V, current—10A, contact pressure—400 g, releasing force—600 g) were measured for 20 times each. The average and highest values were as follows.

| | Average voltage drop (mΩ) | Highest voltage drop (mΩ) |
|---|---|---|
| (1) | 1.1 | 2.8 |
| (2) | 0.8 | 1.4 |
| (3) | 0.78 | 1.4 |

As shown by this results, contact materials made in accordance with this invention require lesser internal oxidation time, resulting in making their production speed higher and hence their production cost lower, and contacts thereof have lower contact resistance in consequence of uniform fine oxidized structures.

I claim:

1. An electrical contact material made from a silver alloy containing solute metal elements of a total amount of from 3—less than 5 weight % of Sn, and 0.01-1.0 weight of Bi, said silver alloy having been internally oxidized.

2. An electrical contact material as claimed in claim 1, in which said silver alloy further contains 0.01-0.5 weight % of one or more elements of the iron family.

* * * * *